US005627414A

United States Patent [19]

Brown et al.

[11] Patent Number: 5,627,414

[45] Date of Patent: May 6, 1997

[54] AUTOMATIC MARINE CATHODIC PROTECTION SYSTEM USING GALVANIC ANODES

[75] Inventors: Fordyce M. Brown, 2485 Indigo Pl., Clearwater, Fla. 34623; Robert P. Mason, 7739 Quaker Neck Rd., Bozman, Md. 21612-0047

[73] Assignees: Fordyce M. Brown, Clear water, Fla.; Robert P. Mason, Bozman, Md.; a part interest

[21] Appl. No.: 388,572

[22] Filed: Feb. 14, 1995

[51] Int. Cl.[6] ..... C23F 13/02

[52] U.S. Cl. ..... 307/95; 204/194; 204/196

[58] Field of Search ..... 307/95; 440/113, 440/900; 60/310; 204/194, 196, 197; 205/291; 324/72; 340/664

[56] References Cited

U.S. PATENT DOCUMENTS

| | | | |
|---|---|---|---|
| 3,098,026 | 7/1963 | Anderson | 204/196 |
| 3,477,930 | 11/1969 | Crites | 204/196 |
| 3,636,409 | 1/1972 | Stephens | 307/95 |
| 4,080,272 | 3/1978 | Ferry | 204/196 |
| 4,129,807 | 12/1978 | Speck | 340/664 |
| 4,160,171 | 7/1979 | Merrick | 307/95 |
| 4,255,242 | 3/1981 | Freeman | 204/196 |
| 4,528,460 | 7/1985 | Staerzl | 307/95 |
| 4,664,764 | 5/1987 | Zofan | 204/196 |
| 4,894,135 | 1/1990 | Farque | 204/196 |
| 5,176,807 | 1/1993 | Kumar | 204/196 |
| 5,298,794 | 3/1994 | Kuragaki | 307/95 |

*Primary Examiner*—William M. Shoop, Jr.
*Assistant Examiner*—Peter Ganjoo
*Attorney, Agent, or Firm*—David Kiewit

[57] ABSTRACT

An automatic system uses sacrificial galvanic anodes to to provide a controlled and optimum amount of cathodic protection against galvanic corrosion on submerged metal parts. Intermittently pulsed control circuitry enables an electro-mechanical servo system to control a resistive element interposed between the sacrificial anodes and the electrically bonded underwater parts. In an active mode of operation a current is applied directly to the anodes to quickly establish the proper level of correction which is maintained during the passive mode. Incremental corrections are made over a period of time to provide stabilization of the protection and to conserve power. A visual indication of the amount of protection is available at all times. Circuitry and indicating devices are included which facilitate location and correction of potentially harmful stray currents and to prevent loss of sacrificial anodes to nearby marine structures.

21 Claims, 5 Drawing Sheets

AUTOMATIC MARINE CATHODIC PROTECTION SYSTEM USING GALVANIC ANODES

BACKGROUND

1. Field of the Invention

This invention relates to a means for conveniently measuring the effectiveness of the bonding system in a boat or marine structure, for automatically providing optimum protection against galvanic corrosion of its immersed metal parts using a system of cathodic protection employing a galvanic anode or anodes, and for indicating the presence of stray currents from power sources which can cause rapid corrosion and/or endanger personnel.

2. Description of Prior Art

Most small to medium boats today are made of fiberglass reinforced polyester resin. Some are made of wood, aluminum or steel. When immersed in sea water, all of their underwater fittings, and in the case of metal hulls the hull itself, are subject to galvanic corrosion. This type of corrosion results from the use of fittings made of alloys and from the use of dissimilar metals in various parts of the boat hull. This hazard results from phenomena internal to and connected to the the boat structure and is, as to cause, unrelated to any external electrical connections or influences.

Galvanic corrosion may be a relatively slow process, but cumulatively over a period of time, it can waste away underwater parts thereby endangering the water-tight integrity of a boat hull and causing engine and other mechanical failures. This type of corrosion typically promotes deterioration and failure of parts made of alloys of copper, e.g. bronze, which always contain from 2% to 10% of zinc and in some bronzes (high tensile) as much as 19% zinc and 10% aluminum. If parts made of these typical alloys are left unprotected, the zinc and aluminum waste away, resulting in ultimate part failure. Brass, which is 67% copper and 33% zinc is extremely vulnerable to galvanic corrosion.

Stray current corrosion caused by unintentional leakage from boat and external power sources can be much more rapid and has resulted in spectacular failures in days, such as a whole propeller blade dropping off, rudder pintles failing, or an entire rudder breaking into pieces. Stray current corrosion should be frequently checked and immediately corrected.

An accepted practice to protect against galvanic corrosion of immersed metal parts is to use a piece, or pieces, of very pure zinc or an alloy of aluminum functioning as sacrificial anodes fastened to each underwater part where possible, or to use a large immersed sacrificial anode which is then electrically connected (bonded) to all underwater parts needing protection. This bonding connection is comprised of a heavy gauge conductor, terminating at the engine block and the negative side of the boat's battery system and forms the vessel's electrical ground.

This practice provides a galvanic couple through the sea water electrolyte between the zinc or aluminum as an anode and the bonded parts, which become the cathode. The current flowing to the cathode overpowers any galvanic cell formation within or between the dissimilar metals of the boat's immersed parts, thereby preventing the loss of metal from immersed boat parts. Instead, the sacrificial anodes will waste away, preventing any harm to the immersed metal parts of the boat or marine structure. The success of this practice depends on a good bonding system having virtually zero electrical resistance between all bonded parts and adequate anode area to provide the necessary protective current in any specific situation.

Some boat builders provide no sacrificial anodes, some do but do not bond all of the immersed metal parts, some provide improper bonding, some do provide a proper bonding system. In all but the first example above, which has no protection, the degree of protection is unknown and should be carefully checked at proper time intervals. Many boat owners merely replace the anodes when the boat is hauled and then hope they have enough protection, but not too much.

Devices are available for checking proper protection of underwater fittings. One commonly used device is a silver/silver chloride half cell which, when immersed in the salt water around the boat, will output a voltage with respect to the boat's bonding system (or to the individual fittings themselves) called the hull potentential, this being the potential of the bonded metal parts with respect to the reference electrode.

Experience has established an optimum range within which the best protection of the immersed fittings and structures is achieved. For a wood or fiberglass boat, the range is between 500 and 700 millivolts. Aluminum and steel-hulled boats have different ranges. Use of the silver/silver chloride half cell has certain serious disadvantages for the pleasure boat user. It is relatively expensive, but, most importantly, it cannot be continually immersed and after a few hours it becomes polarized and fails to function.

The latter drawback dictates that this electrode can be employed only on a short-term basis and cannot be utilized as a reference electrode for a system designed to continuously and automatically control the hull potential at a correct value over extended periods of time, independent of the sacrificial anode area (as long as there is enough) and the salinity of the sea water. As a result of a combination of several factors, most boat owners have no idea whether their boat has the proper protection. The disadvantage of under-protection is the very real danger of damage to underwater parts. Over-protection wastes expensive anodes and risks the destruction of any wood around through-hull fittings. Most fittings on fiberglass hulls are backed up by wood blocks and those blocks can be severely damaged by over-protection currents. Devices are available for interposing a manually operated rheostat between the protective anode and the bonded underwater parts. The sacrificial anode or anodes must be electrically separated from the bonded parts, connected together only by this rheostat. Actual hull potential at a given moment in time can be indicated by using an immersed silver/silver chloride half cell connected to a millivoltmeter, with the other side of the millivoltmeter connected to the bonded underwater parts. The hull potential can be set in the proper range by varying the rheostat resistance—provided there is ample sacrificial anode protection. The disadvantages of this system have been noted—expense and lack of continuous control.

There are a number of impressed current cathodic protection systems described in the literature and available on the market. Some of these control the potential of hull fittings. Some of these are automatic. Impressed current cathodic protection systems utilize a DC voltage to positively energize an immersed anode, with the negative side of the current source tied to the immersed fittings and structures to be protected.

For small to medium sized boats these impressed current cathodic protection systems have several disadvantages, as follows:

1. they can be quite expensive if they are designed to protect an entire boat;
2. the installation can be complex and costly, requiring extensive and careful shielding of the anode(s) from the boat hull;
3. they can require a significant amount of power; and
4. if not properly installed, monitored and maintained, they can cause significant damage to the fittings and the hull coatings.

SUMMARY AND OBJECTIVES

The invention provides optimum corrosion protection to a vessel or marine structure by the use of a stable, continuously immersed reference electrode used by a control system to keep the hull potential within a narrow prescribed range. In a preferred embodiment of the invention, these benefits are obtained from the use of a metal reference electrode and a combination of electronic and electro-mechanical components designed to operate with a very low electrical energy consumption. This allows the system to be used with an expendable source of electrical energy, such as a storage battery or dry batteries. The invention includes means of determining the quality and performance of the bonding system by which immersed metallic parts are connected to the electrical ground of a vessel or marine structure.

A preferred embodiment of the invention provides a tri-modal cathodic protection system and apparatus for use on a vessel or other marine structure having a common electrical ground. In the first mode of operation, termed the set-up mode, a controller comprising an operational amplifier is employed to initially establish a current through the protected parts via the sacrificial anode. This current will be near the equilibrium value establishing the optimum hull potential. In a second, active, mode of operation of this system a controller comprising an operational amplifier measures the voltage between the protected parts bonded to the ground and a reference electrode. The controller adjusts a rheostat connected between a source of cathodic protection current (a sacrificial anode) and the protected parts in order to drive the measured potential to a predetermined level. In a third, passive, mode of operation the rheostat (which has the resistance value attained at the end of the preceding active mode period) remains connected between the sacrificial anode and the protected metallic members of the vessel or structure for a predetermined time-period.

It is an object of the invention to provide apparatus for the measurement and display, to an operator, of the bonding status of a selected immersed metallic part on a vessel.

It is an additional object of the invention to provide apparatus for the measurement and display, to an operator, of stray electrical currents that may be associated with a faulty connection between a vessel's power system and an on-shore electric mains source, or to faulty wiring or components utilizing the AC mains source or the vessel's DC power system.

It is yet an additional object of the invention to provide means for isolating protected metallic parts on a vessel or marine structure from external sources of galvanic corrosion without thereby posing a risk of electrocution.

It is a further object of the invention to provide means of indicating, to a person on a vessel, the presence of either structurally damaging leakage currents or of a significant electric shock hazard.

DETAILED DESCRIPTION AND OPERATION

Figure 1:
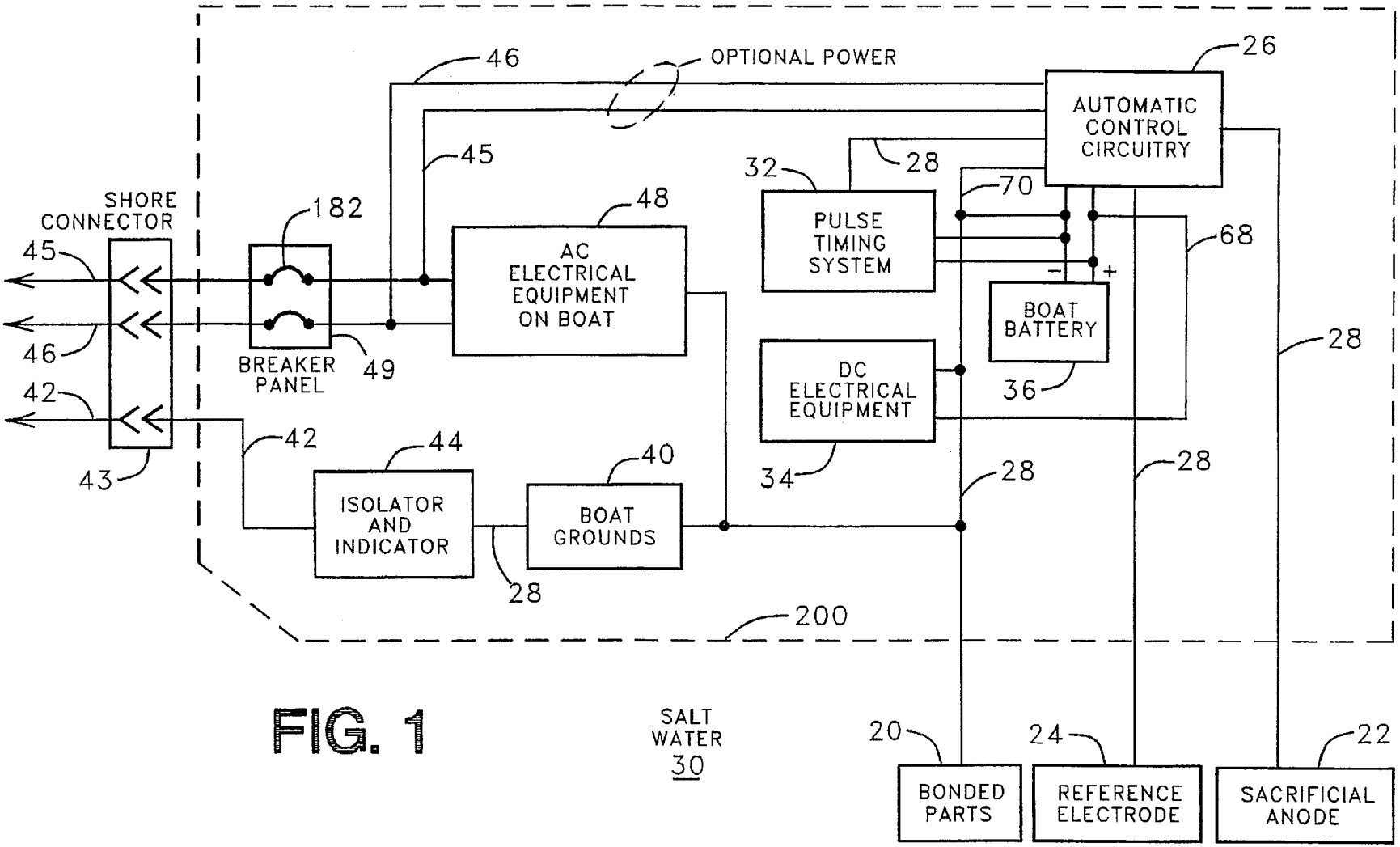
FIG. 1 of the drawing is a block diagram of a system of the invention.

This invention is comprised of two main parts—an automatic control means 26 shown in the schematic block diagram in FIG. 1 and an isolation and indication means 44 similarly shown in FIG. 1. Two modes of automatic control are utilized, both with the automatic control unit 26 interposed between the bonded metal underwater parts 20 and the submerged sacrificial anode 22 using the reference voltage from electrode 24, with all underwater parts being submerged in sea-water electrolyte 30. The voltage of the reference electrode is utilized to maintain the protected parts 20 at a predetermined hull potential.

A preferred reference electrode 24 is fabricated from extremely pure copper (99.95+%) Goodfellow Metals Cambridge, Ltd. in Cambridge CB4 4DJ, England. It has less than 113 parts/million of impurities, remains stable as to output, and resists marine growth in salt water. It can be potted into a through-hull fitting, used as a transom-mounted assembly, or simply dipped into the salt water. All of the components are connected together by suitable wires 28 as indicated in FIG. 1.

The preferred long term mode of operation of the control apparatus is termed the active mode. By means of circuitry shown in FIG. 2, to be described in detail, an electromechanical servo system comprising a voltage sensor, control circuitry and a motor driving a variable resistance comes to a balance point when the hull potential reaches the proper value. The motor 52 is driven by an emitter-follower bridge 56.

Figure 3:
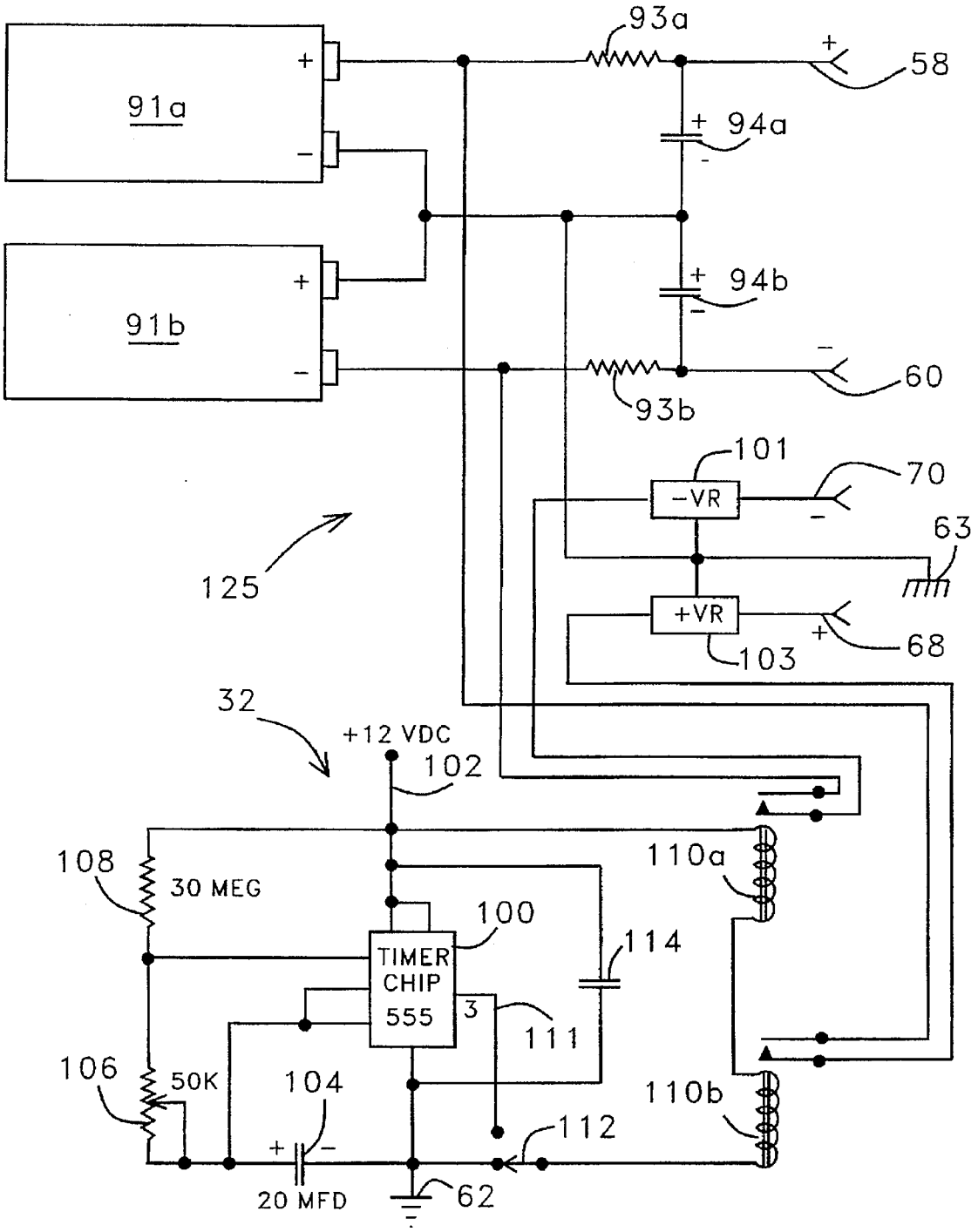
FIG. 3 of the drawing is a schematic circuit diagram showing a battery-driven power supply usable with the cathodic protection system of the invention and an electrical circuit diagram of a pulse-timing circuit usable to control the power consumption of a system of the invention.

A first short-term mode of operation, designated the set-up mode, is employed to initially and quickly establish a current through the protected parts, the salt water electrolyte and the anode. This set-up current varies but in time approaches that needed to produce an equilibrium value required, under the existing conditions, to maintain the optimum hull potential as indicated on meter 80. The output 59 of the transistor bridge 56 is switched by switch 64 to the wire leading to the underwater anode 22 until equilibrium is reached and is then switched back to the motor 52. The set-up mode is preferably used for only a short term since its current drain on the battery supply 91*a* and 91*b* in FIG. 3 is relatively high.

Figure 2:
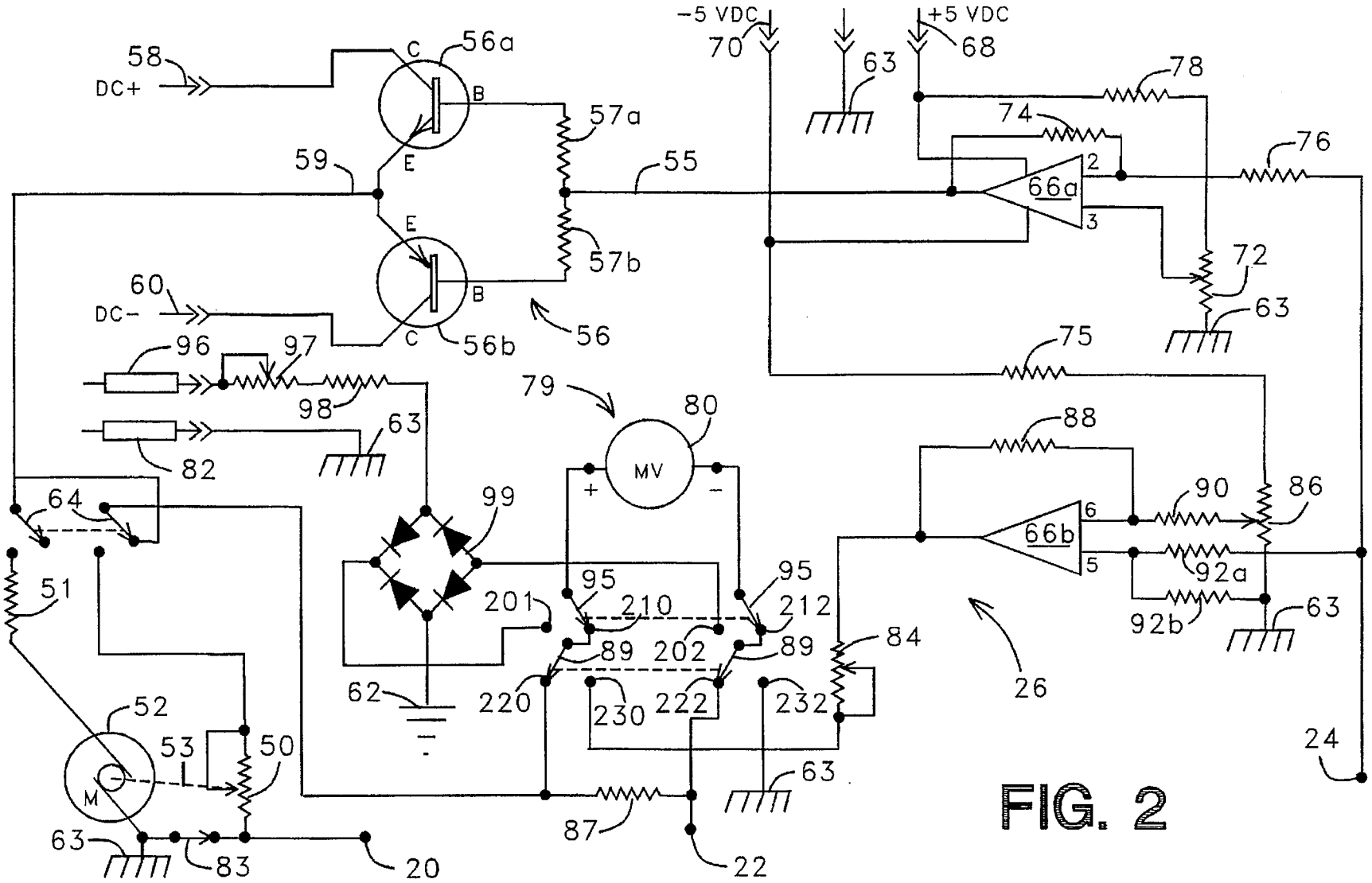
FIG. 2 of the drawing is a circuit diagram of an electronic and electro-mechanical automatic cathodic protection system.

Referring to FIG. 2, the set-up control mode may utilize an emitter-follower bridge circuit 56 comprising one NPN transistor 56*a* and one PNP transistor 56*b* connected in series, with the common emitter connected to the sacrificial anode 22. When a positive voltage 58 is connected to the collector of the NPN transistor 56*a* and a negative voltage of roughly equal magnitude is connected to the collector of the PNP transistor 56*b* at 60, the potential of the sacrificial anode 22 is adjusted to change the current between the anode 22 and the protected (bonded) parts 20 through the salt-water medium 30 in such a way that the desired hull potential (measured between the reference electrode and the protected parts) is established. Once this potential is reached the second, active, control mode is substituted for the set-up mode by switching the sacrificial anode 22 to the control rheostat 50, as well as switching the control voltage 59 to motor 52 with switch 64, thus driving the rheostat 50 to a resistance value which maintains the hull potential close to the desired value. Through repeated samplings and corrections, the resistance of the rheostat 50 is adjusted to establish and then maintain the current which produces the desired hull potential under changing circumstances, over long periods of time.

The control voltage on the emitter-follower bridge 56 is produced by a circuit comprising amplifiers 66*a*, 66*b*. The output of 66*a* is connected by lead 55 to the bases of bridge 56 transistors by current limiting resistors 57*a*, 57*b*. The dual operational amplifiers 66*a*, 66*b* can be of the Harris Semiconductor Type CA1458T or equivalent, and may be powered in the usual way by two voltage sources 68 and 70 (one positive, one negative) of roughly equal value. The common interconnection of the two voltage supplies 91*a*, 91*b* as shown in FIG. 3 is connected to the internal chassis ground 63 of the control circuitry 26.

The inputs to the operational amplifier 66*a* consist of an offset reference voltage at the wiper of the potentiometer 72 (which establishes the voltage level at which the hull potential is maintained) and the voltage of the reference electrode 24 (with respect to which the hull potential is measured). The resistance values of the input network to the operational amplifier 66*a* are selected to provide the highest gain practical while maintaining the lowest current drain from the reference electrode 24. The gain is determined by the ratio of the resistance value of the feedback resistor 74 to the resistance of the input resistor 76 at the inverting input 2. Values of 10 megohms and 10K ohms, respectively, have been used successfully, resulting in a gain of 1000, which limits the reference electrode 24 current to less than 50 microamperes. Other values could be successful as well. Potentiometer 72, which provides an adjustable reference control voltage for the non-inverting input of the operational amplifier 66*a*, derives its power from the regulated positive voltage supply 68 through a fixed resistor 78.

Another portion of the preferred control means consists of a hull potential indicator 79. The indicator 79 is comprised of a meter 80 and a second operational amplifier 66*b* to drive it through a calibration rheostat 84. The inputs to opamp 66*b* consist of the reference electrode 24 (at the non-inverting input 5) and the wiper of a calibration potentiometer 86 (at the inverting input 6). The gain of the opamp 66*b* is set at unity by appropriate selection of resistors 88, 90, 92*a*, and 92*b*. The added current drain from the reference electrode 24 due to the high resistance of the input resistors 92*a*, 92*b* is negligible.

A power supply 125 for the control means can be any suitable type which will produce approximately six volts positive and six volts negative at fifty or more milliamperes capacity. It is imperative that no power supply be used that can cause an unknown or uncontrolled effect on the galvanic currents through the protected underwater parts or the sacrificial anode. These power supplies must be isolated from the boat's batteries and the AC line. Three forms of electrical power supply have been successfully used interchangeably.

FIG. 3 illustrates the use of, for example, a pair of nine volt batteries 91*a* and 91*b* as a power source. These are isolated because there is no connection except to the circuits they are powering. The batteries are connected in series, with the common interconnecting terminals also connected to the common point 63 of the circuits. Two three-pin fixed voltage regulators 101 and 103 provide regulated power to the control circuit in FIG. 2 at 68 and 70 through the contacts of relays 110*a*, 110*b* in the pulse timer shown in FIG. 3. The remaining positive and negative terminals provide unregulated power to the appropriate circuits in FIG. 2 directly at 58 and 60 through current limiting resistors 93*a*, 93*b*. To provide a current surge to overcome motor friction and to start motor 52, a pair of capacitors 94*a* and 94*b* (preferably of about 4000 microfarads) are connected between common point 63 and the output terminals 58 and 60 leading to the transistors 56*a*, 56*b*.

Batteries 91*a*, 91*b* may have a nominal capacity of 500 ma hours. The circuit drain averages about 10 ma and would, therefore, use up pair of batteries in about fifty hours, or two days. It is thus beneficial to provide a timer to activate the control circuit only at intervals to increase battery life. A timer interval of about nine minutes for a duration of about one-half second has been used very successfully. If a peak current of 50 ma is used for one-half second each nine minutes, the battery life of ten hours is extended by 1080 times, and becomes 10800 hours, or 1.23 years.

A suitable pulse timer 32 is illustrated in FIG. 3. A timer 100, which may be a Harris Semiconductor type CA 555CE, or equivalent, is connected to a positive voltage supply of between five and fifteen volts. Appropriately selected resistors 106, 108, and capacitors 104, 114 may be used with timer 100 so that the timer output lead 111 will drop from the supply voltage 102 to the ground voltage 62 for a duration of about one-half second maximum (which may be adjusted by setting the rheostat 106) at an interval of about nine minutes. For convenience in using the system on a boat, an available twelve volt DC supply is used to power the timer. A pair of five volt reed relays 110*a* and 110*b* are actuated during the approximate one-half second interval which connect the positive 68 and negative 70 voltage supplies to the opamps 66*a* and 66*b*.

The set-up mode is generally used only for installation and startup of the protection system of the invention. In the active mode, variable resistor 50 in FIG. 2 is driven by motor 52 through a mechanical coupling 53 to a resistance value which sets the desired hull potential of the protected underwater parts 20, as measured with respect to the voltage reference electrode 24. The intermittent operation of the control circuit leaves the rheostat 50 at the resistance value last set which continues to provide optimum, or near optimum, protection until a later adjustment is made. Because of the need to switch between continuous and pulsed modes of operation, a single-pole single-throw switch 112 (FIG. 3) is inserted between the relays 110*a*, 110*b* and the output 3 of the timer chip 100. This permits the relays 110*a* and 110*b* to be continuously actuated when switch 112 is switched to the ground terminal 62. A capacitor 114 (which preferably exceeds 0.1 microfarad in value) is used, as is known, to bypass power supply noise and allow stable operation of the timer 100.

Again, referring to the control circuit illustrated in FIG. 2, the detailed operation of the normally utilized pulsed active mode is described. When the timer 100 activates relays 110*a* and 110*b*, the control circuit 26 is energized. The reference electrode 24 creates a voltage with respect to the protected parts 20, which are in turn connected to the boat ground 62.

The current between the reference electrode 24 and the protected parts 20 passes through the input resistor 76 of opamp 66*a*. The opamp 66*a* compares the voltage at its inverting input 2 and the reference voltage of the wiper of potentiometer 72 at the non-inverting input 3. The opamp 66*a* drives its output voltage to reduce the difference by feeding current through a feedback resistor 74 to its inverting input 2 until the voltages at the inverting input 2 and non-inverting input 3 are equal. To compensate for a one millivolt difference at the inputs, a one volt change at the output is necessary with the exemplar values. The opamp output voltage causes current to flow in the cathode follower bridge transistors 56*a*, 56*b*. A reduced hull potential causes a positive voltage at the opamp 66*a* output. This causes current to flow in the NPN transistor 56*a* which flows through the motor 52, causing it to rotate and increase the resistance of the rheostat 50. This increase in resistance reduces the current between the sacrificial anode 22 and the protected parts 20, raising the hull potential closer to the desired level, as set by potentiometer 72. Alternatively, an elevated hull potential will cause a negative opamp output voltage. This will cause current to flow in the PNP transistor 56*b* which causes current to flow in the opposite direction through the motor 52, causing it to rotate and thereby decrease the resistance of the rheostat. This decrease causes the current between the sacrificial anode 22 and the protected parts 20 to increase, bringing the hull potential down closer to the desired level. The new rheostat setting will remain constant until the timer again energizes the control circuit, which compares and adjusts as needed.

The concept of approaching the balance point of the servo system via intermittent pulses is an important part of the preferred embodiment of the invention. This method prevents over- or under-correction of the hull potential, which may otherwise occur because of a relatively long time period required for immersed parts 20, 22, 24 to reach equilibrium at a new setting of the rheostat 50. In accordance with the intermittent pulsed approach, the opamps 66*a*, 66*b* are activated and shut off by a square wave input having a relatively short duration. During this time period when the power to the control circuitry 26 is switched off, the system is in the third, passive, mode.

The preferred embodiment uses a power supply 125 for the controller which must be dielectrically isolated from any other DC or AC supply of the vessel or marine structure, and that has a total output current in excess of fifty milliamps. Outputs from the supply preferably comprise both unregulated +/−9 V DC, and stabilized (where the stabilization is preferably on the order of 1%) positive and negative DC outputs at five to six volts.

Figure 4:
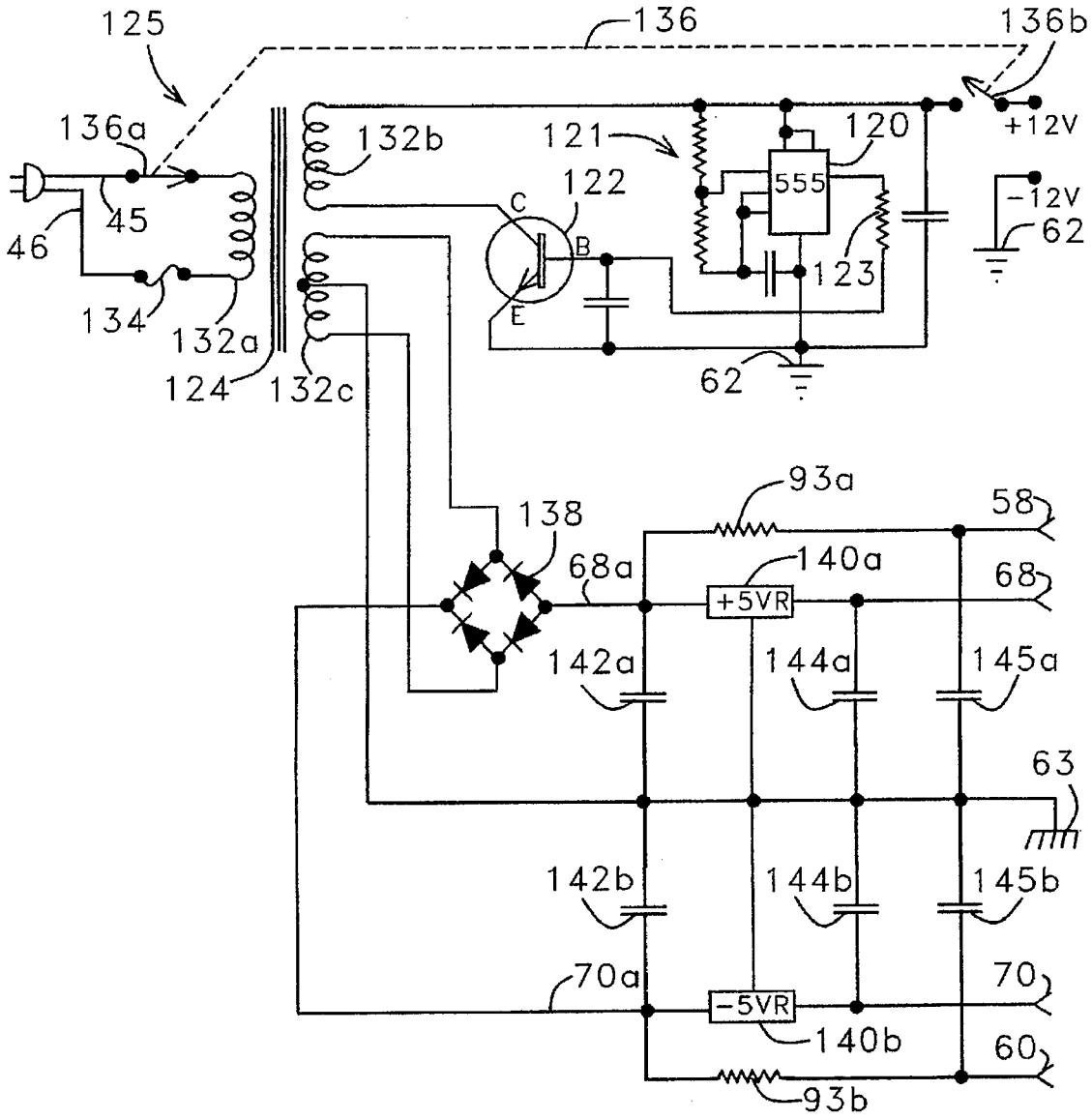
FIG. 4 of the drawing is an electric circuit diagram of an alternative power supply to that depicted in FIG. 3.

Two sources of isolated power are shown in FIG. 4 of the drawing. One of these is the 12 V DC power generally available on small vessels, and the other is 115 V AC that may be available either from on-shore electric mains if the vessel is at dockside, or from an on-board engine-driven generator. The electrical power supply 125 circuitry illustrated in FIG. 4 shows that either of the two input sources can power the automatic control apparatus 26.

Isolation of the power supply 125 may be provided by an isolation transformer (see FIG. 4) 124 that preferably has two input windings 132*a*, 132*b* and an output winding 132*c*. Mains current (e.g. 115 V AC) may be supplied to a first input winding 132*a*, which may comprise 1400 turns of #34 AWG wire. Pulsating 12 V DC current, derived from the vessel's 12 V DC power supply by means to be subsequently herein described, may be supplied to the second input winding 132*b* (which may comprise 100 turns of #24 AWG wire). For either of these inputs, the output from the center-tapped output winding 132*c* (which may comprise 200 turns of #28 AWG wire) is an isolated AC current having approximately 20 volts peak-to-peak.

Primary excitation of the transformer 124 can be achieved either from 115 V AC sources 45 and 46 of FIG. 1 or from 12 V DC battery 36 of FIG. 1 via the oscillator and amplifier circuits described below.

In the DC input power option, a double-pole double-throw switch 136 is actuated to disconnect the AC power source at 136*a* in FIG. 4 and to close 136*b*, thus connecting the 12 V DC power source to an oscillator and amplifier circuit 121 comprising a timer 120 and a power transistor 122 which drive 100 HZ pulsating DC current through the transformer winding 132*b*. The pulsed current through the primary winding 132*b* of transformer 124 excites the secondary winding 132*c* through the magnetic circuit coupling of the isolation transformer 124.

As an alternative source, AC power can be used to excite the secondary 132*b* of transformer 124 by actuating switch 136 to close contact 136*a* and opening contact 136*b*, applying AC voltage to primary winding 132*a* through protecting fuse 134.

From either power source, winding 132*c* is excited to about 20 V AC peak-to-peak. Rectifier bridge 138, together with capacitors 142*a* and 142*b*, converts the alternating current to a smooth direct current at about 20 volts at the power supply outputs 68*a* and 70*a*. The intermediate zero voltage at common point 63 is connected to the center-tap of winding 132*c* producing approximately plus 10 volts at 68 and minus 10 volts at 70, replacing the battery supply shown in FIG. 3.

Unregulated voltages needed to power the emitter-follower bridge 56 of FIG. 2 are provided through current-limiting resistors 93*a* and 93*b*. Regulated voltages of positive 5.0 and negative 5.0 with respect to the common connection 63 are provided by utilizing 3-pin voltage regulator chips 140*a* and 140*b* to provide stable reference voltages for the opamps 66*a* and 66*b*. Capacitors 145*a* and 145*b* provide stored energy for a quick release to drive the motor 52 during normal pulsed operation. Capacitors 144*a* and 144*b* are required to provide stable operation of the regulator chips 140*a* and 140*b*.

Figure 5:
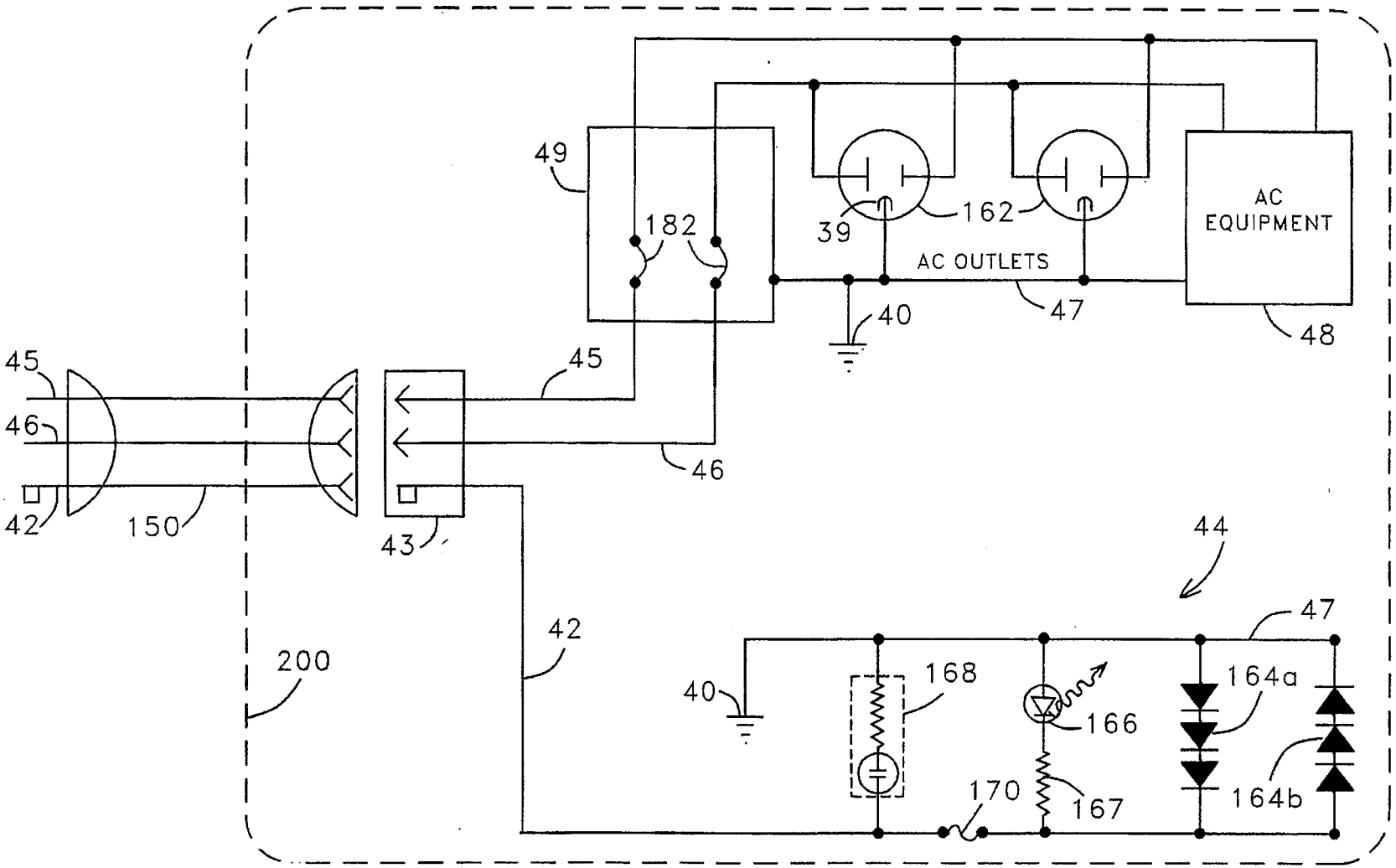
FIG. 5 of the drawing is an electric circuit diagram of isolation and leakage current detection means usable with the apparatus of the invention.

Docked vessels or marine structures 200 in FIG. 5 have metal parts 20 immersed in sea water 30 and may also have equipment 48 powered from a land-based source. In these cases grounding connections 42 are made between the land and water-borne structure as a safety precaution to prevent severe electrical shock to personnel on or near the structure. The purpose of the grounding conductors 42 is to provide a low resistance path for possible electrical currents caused by erroneous connections or faulty insulation in the equipment 48. The grounding path 47 from the equipment housing is required to have sufficient current-carrying capacity to cause a circuit protection device 182 to disengage the power source, should a fault condition exist.

A galvanically generated current from a nearby similarly grounded structure (which may be at a different hull potential) can create a damaging current which overpowers the protection system of one or both structures. Since galvanically generated voltages never exceed about 2 volts, isolation can be achieved with strings of 164*a*, 164*b* series-connected solid state diodes in the grounding conductor with the strings wired in such a manner as to conduct in directions opposite to each other. Each diode will pass no current until its work-function voltage is exceeded, typically about 0.9 volts. Three diodes in series thus requires 2.7 volts to be exceeded before current will flow. This voltage barrier will effectively block any currents from galvanic sources. The resulting voltage difference of 2.7 volts between the shore ground 42 and the structure ground 40 does not compromise the safety function of the grounding elements since only about 3 volts is maintained across the diodes even when large currents are flowing.

Leakage currents from the electrical equipment are driven by voltages which are likely to exceed the 2.7 volts. Should such currents occur at levels below that necessary to open the fuse or breaker 182 at panel 49, some indication is necessary to show that a possibly damaging current is flowing. An indicator light 166 which is energized below but near the 2.7 voltage level may be included in the isolation and indicator means 44. As a further precaution to avoid unseen danger, a fuse 170 is included in the current path to the leakage indicator 166 and diode strings 164*a*, 164*b*. While the diode current capacity would be selected to exceed the current required to trigger the breaker, should the leakage currents exceed the diode capacity and not open the breaker, the fuse 170 will blow and cause an indicator light 168 to be energized as a shock hazard warning. An alarm bell or some other attention attracting device could also be employed.

In FIG. 5, one finds shore power taken via a power cable 150 consisting of three conductors: a "hot" AC line 45, the ground or return line 46 (always attached to an earth ground on shore) and the grounding or green conductor 42 that is also always attached to earth ground ashore to provide the safety path for unintended leakage currents which are usually due to faulty insulation in powered equipment. The grounding conductor 42 is not directly connected to the "cold" or return line 46 nor to the boat ground 40 at any point on the boat. A connector 43 for the cable 150 is attached to the marine structure and routes the conductors 45 and 46 within the structure to a power distribution panel 49 which contains fuses or breakers 182. Inside the boat or structure the grounding conductor 42 is routed separately to the isolation and indicator means 44. The grounding conductor 47 is connected to the boat ground 40, which is the safety return conductor for all electrical equipment on the marine structure, through a number of paths.

The system of the invention also facilitates trouble-shooting when failures of wiring insulation, bonding of underwater parts or electrical components are indicated or suspected. The testing capabilities of the system include: monitoring the protective current supplied; testing the bonding integrity of various protected parts; and identifying electrical equipment responsible for leakage currents.

To monitor the protection current, double-pole double-throw switches 89, 95 (shown, for purposes of clarity of presentation, without the conventional schematic designation of the mechanical linkage between poles) are set as shown in FIG. 2 so that the meter 80 is connected across a calibrated shunt resistor 87. Thus, the reading on the meter 80 represents the magnitude of the galvanic protection current flowing between the sacrificial anode 22 and the protected parts 20. This current monitoring setting has been found to be particularly useful during initial set-up procedures of the system.

To measure the hull potential of the protected marine structure 200 in FIG. 5 a calibrated millivoltmeter is created as follows: the meter 80 is connected via the first double-pole double-throw switch 95 to contacts designated as 210 and 212, and via the second double-pole double-throw switch to contacts designated as 230 and 232. Additionally, the single-pole single-throw chassis-to-ground switch 83 is closed, and the single-pole double-throw switch designated with reference numeral 112 is connected to ground 62 as shown in FIG. 3. This arrangement connects one side of the meter 80 to the interconnected common point 63 and ground 62, and connects the other side of meter 80 to the output of the linear amplifier 66*b*, and indicates the hull potential when switch 112 closes relays 110*a*, 110*b* and applies power to opamp 66*b*.

To verify the bonding integrity of the underwater parts to be protected, the millivoltmeter configuration described above is selected. A bonding probe 82 connected to the chassis ground 63 is then used to make electrical contact to an underwater part or fitting accessible from the interior of the structure or vessel 200, and the single-pole single-throw switch 83 (which may be a normally-closed momentary switch) is opened to disconnect the common point 63 from the vessel ground 62. It has been found that if a change of more than ten to twenty millivolts is observed on opening the switch 83, the underwater part under test is improperly bonded to the vessel ground 62.

Sources of leakage current from powered equipment can also be identified with the system of the invention. For this measurement, a voltmeter is created as follows: the first double-pole double-throw switch 95 connected to the meter 80 is thrown from the status illustrated in FIG. 2 (i.e., connecting the meter 80 to contacts 210, 212) to its other position (i.e., connecting the meter to a bridge rectifier 99 and a first probe 96 via contacts 201, 202). The meter 80 is then calibrated to operate with the maximum voltage to be encountered (e.g., by means of the combination of a fixed dropping resistor 98 and an instrument rheostat 97). The suspected item of powered equipment is then isolated from the structure ground 62 and the housing or other chassis ground of the equipment under test is touched with the leakage test probe 96. Properly functioning powered equipment will show no voltage when so tested.

Alternately, a source of stray currents can be determined by a sequence of measurements of the hull potential with respect to the reference electrode 24. With the meter 80 in the millivoltmeter configuration as described supra, all the power-utilizing equipment on the vessel or marine structure 200 is turned off, but no bonding connections are interrupted. The various items of electrical equipment are then turned on one at a time and the hull potential is measured. A change in hull potential when an equipment is turned on will determine which one is the source of the problem.

Although we have shown and described certain specific embodiments of our invention, we are aware that many other modifications thereof are possible. Our invention, therefore, is not to be limited to the precise details shown and described, but it is intended to cover all modifications coming within the scope of the appended claims.

We claim:

1. In a cathodic protection system protecting a metal part of a marine structure having an electrical ground, the part immersed in an electrolyte, the system comprising a sacrificial anode immersed in the electrolyte, an improvement comprising:

a metal reference electrode continually immersed in the electrolyte;

a controller powered by an electrical power supply, the controller switching from an active mode having a first predetermined duration to a passive mode having a second predetermined duration, the controller powered in the active mode by the power supply and having, as inputs, electrical connections to the electrical ground and to the reference electrode, the controller having an electrical output when in the active mode, the controller having no electrical output when in the passive mode; and a variable resistor electrically connected intermediate the sacrificial anode and the protected metal part;

wherein the output of the controller controls the voltage between the reference electrode and the protected part by controlling the electrical resistance of the variable resistor.

2. The system of claim 1 wherein the electrical resistance of the variable resistor remains at the value last set during the active mode when the controller switches from the active mode to the passive mode.

3. The system of claim 1 further comprising a timer switching the controller between the active mode and the passive mode.

4. The system of claim 1 wherein the reference electrode comprises pure copper having less than 200 parts per million total impurities.

5. The system of claim 1 further comprising indicator means providing a visual display to an operator of the voltage between the reference electrode and the protected part.

6. The system of claim 1 wherein the electrical power supply is isolated from all other sources of electric power on the structure.

7. The system of claim 1 wherein the electrical power supply comprises a battery not connected to an electric power of the structure.

8. The system of claim 1 wherein the electrical power supply comprises a battery electrically connected to an electric power system of the structure, an oscillator and amplifier circuit electrically connected to the battery, and an isolation transformer electrically connected to the oscillator and amplifier circuit.

9. The system of claim 1 wherein the electrical power supply comprises an isolation transformer electrically connected intermediate the controller and an on-shore electric mains supply.

10. The system of claim 1 further comprising a diode string electrically connected intermediate a shore ground and the electrical ground of the marine structure, the diode string having a turn-on voltage exceeding the greatest voltage supplied by a single galvanic cell.

11. The system of claim 1 further comprising a diode string electrically connected intermediate a shore ground and the electrical ground of the marine structure, the diode string having a turn-on voltage lower than the voltage of an on-shore AC mains power supply.

12. The system of claim 1 comprising a plurality of protected parts, each part of the plurality of parts electrically bonded to the electrical ground.

13. In a cathodic protection system protecting a metal part of a marine structure having an electrical ground, the part immersed in an electrolyte, the system comprising a sacrificial anode immersed in the electrolyte, an improvement comprising a metal reference electrode continually immersed in the electrolyte;

a controller powered by an electrical power supply, the controller switchable between an active mode and a passive mode, the controller powered in the active mode by the power supply and having, as inputs, electrical connections to the electrical ground and to the reference electrode, the controller having an electrical output when in the active mode; and a rheostat having a wiper contact driven by an electric motor, the motor controlled by the output of the controller;

wherein the output of the controller controls the voltage between the reference electrode and the protected part by controlling a the electrical resistance of the rheostat.

14. The system of claim 13 wherein the controller comprises an operational amplifier having inverting and non-inverting inputs, the inverting input electrically connected to the reference electrode, the non-inverting input electrically connected to the electrical ground, the output of the controller controlling an electric motor moving the wiper contact.

15. The system of claim 14 further comprising a transistor bridge electrically connected intermediate the operational amplifier and the motor, the bridge having operatively connected to a first terminal thereof a positive DC voltage from the power supply, the bridge having operatively connected to a second terminal thereof a negative DC voltage from the electrical power supply.

16. A method of using an electronic controller having an output responsive to an input voltage to cathodically protect a metal portion of a marine structure, the metal portion immersed in an electrolyte, the method comprising the steps of:

a) providing, as the input voltage, a voltage between the protected portion and a metal reference electrode continually immersed in the electrolyte;

b) changing, responsive to the output of the controller, the electrical resistance of a variable resistor electrically connected intermediate the protected portion and a sacrificial anode immersed in the electrolyte until either b1) the voltage between the protected portion and the reference electrode attains a predetermined value or b2) a first predetermined time interval elapses;

c) holding the resistance of the variable resistor constant for a second predetermined time interval, and d) repeating steps a) through c).

17. The method of claim 16 further comprising a start-up procedure executed prior to step a) thereof, the startup procedure comprising the steps of i) causing electric current to flow from a supply thereof through the sacrificial anode, the electrolyte and the metal portion, ii) measuring the voltage between the reference electrode and the protected part, and iii) disconnecting the supply from the sacrificial anode when the voltage attains a predetermined hull potential value.

18. The method of claim 16 further comprising a start-up procedure executed prior to step a) thereof, the startup procedure comprising the steps of i) causing electric current to flow from a supply thereof through the sacrificial anode, the electrolyte and the metal portion, ii) measuring the current between the reference electrode and the protected part, and iii) disconnecting the supply from the sacrificial anode when the current attains an equilibrium value.

19. Apparatus for testing the integrity of the electrical bonding of a metal part to an electrical ground on a marine structure in contact with an electrolyte, the marine structure protected from corrosion by a cathodic protection system comprising an electrically connected sacrificial anode, the apparatus comprising:

a millivoltmeter having an input connected to a metal reference electrode continually immersed in the electrolyte, the millivoltmeter having a second input connected to an electrical common point;

a bonding probe electrically connected intermediate the common point and the metal part;

a switch having an open state and a closed state, the switch connecting the common point to the electrical ground when in the closed state, the switch isolating the common point from the electrical ground when in the open state, whereby a lack of integrity of the bonding is indicated by a change of more than a predetermined value in the voltage measured by the millivoltmeter, the change occurring on switching the switch from the closed to the open state thereof.

20. Apparatus of claim 19 wherein the predetermined value is ten millivolts.

21. Apparatus of claim 19 wherein the millivoltmeter is connected to the reference electrode through an amplifier powered by an electrical power supply electrically isolated from all other sources of electric power on the structure.

* * * * *